US006447244B1

(12) United States Patent
Clements

(10) Patent No.: US 6,447,244 B1
(45) Date of Patent: Sep. 10, 2002

(54) CENTRIFUGAL PUMP APPARATUS AND METHOD FOR USING A SINGLE IMPELLER WITH MULTIPLE PASSES

(75) Inventor: Martin A. Clements, North Royalton, OH (US)

(73) Assignee: Argo-Tech Corporation, Cleveland, OH (US)

( * ) Notice: Subject to any disclaimer, the term of this patent is extended or adjusted under 35 U.S.C. 154(b) by 0 days.

(21) Appl. No.: 09/567,883

(22) Filed: May 10, 2000

Related U.S. Application Data

(60) Provisional application No. 60/134,271, filed on May 14, 1999.

(51) Int. Cl.[7] ..... F01D 3/02

(52) U.S. Cl. ..... 415/98; 415/100; 415/102; 415/206; 415/1

(58) Field of Search ..... 415/97, 98, 100, 415/101, 102, 206, 55.5, 1

(56) References Cited

U.S. PATENT DOCUMENTS 1,309,282 A * 7/1919 Frame ..... 415/100
1,743,348 A * 1/1930 Hollander ..... 415/98
2,944,785 A * 7/1960 Sampietro ..... 415/102
4,408,952 A * 10/1983 Schweinfurter ..... 415/55.5
4,664,592 A 5/1987 Grzina
4,720,242 A 1/1988 Lovisetto
5,082,425 A 1/1992 Reil et al.

* cited by examiner

*Primary Examiner*—F. Daniel Lopez
*Assistant Examiner*—Richard Woo
(74) *Attorney, Agent, or Firm*—Fay, Sharpe, Fagan, Minnich & McKee, LLP

(57) ABSTRACT

A method of increasing the pressure of a fluid in an aircraft centrifugal pump by forcing the fluid to make multiple passes through one impeller of the aircraft centrifugal pump is provided. It includes providing fluid through a pump inlet to an aircraft impeller inlet. The fluid then exits the impeller through a first set of discharge ports and the exiting fluid is directed to a second inlet on the same impeller. The fluid then exits the impeller through a second set of discharge ports to a pump outlet. Each pass through the impeller by the fluid increases the pressure thereof.

20 Claims, 3 Drawing Sheets

CENTRIFUGAL PUMP APPARATUS AND METHOD FOR USING A SINGLE IMPELLER WITH MULTIPLE PASSES

This application claims the benefit of U.S. Provisional Application Serial No. 60/134,271, filed on May 14, 1999.

BACKGROUND OF THE INVENTION

1. Field of the Invention

The present invention relates to centrifugal pumps, and more particularly, to an improved impeller for use in a centrifugal pump. The present invention finds particular application in conjunction with an aircraft fuel pump, and it will be described with particular reference thereto. However, it is to be appreciated that the present invention is also amenable to other like applications.

2. Discussion of the Art

The structure and operation of centrifugal pumps is well known in the art. Briefly, fluid generally enters a pump inlet in an axial direction and due to the rotation of the impeller the fluid centrifugally flows radially outward through a set of channels defined between impeller blades. The fluid discharges from the impeller around the peripheral edge of the impeller. The centrifugal action of the fluid flowing outwardly through the channels creates a suction at the central area of the impeller which serves to continuously draw more fluid into the inlet of the pump.

The fluid discharged from the impeller is at a significantly higher pressure than the fluid entering the pump inlet. The major portion of the energy imparted to the fluid is converted to a pressure head by means of a volute, diffuse, or other system.

Impellers may generally be classified according to their flow arrangements. Single-suction impellers receive fluid through a single inlet on one face of the impeller. Double-suction impellers generally have fluid flowing onto opposed faces of the impeller. The fluid streams flowing into each face of a double-suction impeller are usually commingled within impeller fluid channels or at the periphery of the impeller before exiting the pump.

Centrifugal pumps may additionally be classified as either single-stage pumps or multi-stage pumps. Single-stage pumps are generally defined as those in which the pressure head was developed by a single pass through only a single impeller. Multi-stage pumps generally refer to pumps using two or more impellers operating in series. Additionally, a single impeller, double suction pump has been, heretofore, generally classified as a single-stage pump.

Multi-stage pumps are often used in applications that require large volumes of liquid to be delivered at high pressures. Each stage incrementally imparts rotational energy into the fluid thereby increasing the amount of pressure of the fluid at each stage. Although the delivery of a high volume of fluid at high pressures is desirable, several disadvantages are present in the prior art.

One disadvantage of multi-stage pumps is that substantial internal energy losses result from using additional impellers because each impeller frictionally interfaces with the surrounding pump casing or housing. The mechanical drag results in lower pump efficiency.

Another disadvantage is that each additional impeller stage adds volume and weight to the overall pump assembly. Increased volume or size may prevent installation of the pump unit in tight-fitting applications. Increased weight may cause inefficiencies in particular applications such as for use as an aircraft fuel pump where the load capacity of the aircraft is limited.

Therefore, it is desirable to provide an improved impeller for use in a centrifugal multi-stage pump that overcomes these problems and others.

BRIEF SUMMARY OF THE INVENTION

In accordance with the present invention, an improved impeller for use in a single-impeller, multi-stage centrifugal pump is provided for minimizing these and other disadvantages of the prior art.

More particularly, a preferred embodiment of the present invention has an impeller provided with multiple inlets and corresponding sets of discharge ports. Multiple pump stages are accomplished by successively passing the fluid through the impeller by entry into the various inlets of the impeller.

A preferred embodiment of the centrifugal pump includes a housing having a pump inlet and a pump outlet that communicate with an internal chamber. A rotatable shaft drives a generally cylindrical impeller operatively received in the internal chamber. The impeller includes a first impeller face, a second impeller face opposite from the first impeller face, and a radial peripheral edge extending around the circumference of the impeller and interconnecting the first and second impeller faces. The impeller also includes a first impeller inlet located on one of the first and second impeller faces and a second impeller inlet located on one of the first and second impeller faces. Additionally, a first and second set of impeller outlet ports are located on the impeller. The first set of channels communicate between the first impeller inlet and the first set of impeller outlet ports disposed in the impeller while the second set of channels communicate between the second impeller inlet and the second set of impeller outlet ports disposed in the impeller.

According to a preferred method of the present invention increased pressure of a fluid in a centrifugal pump having a single impeller is provided. The method includes the steps of providing fluid through a pump inlet to a first impeller inlet. Fluid exiting the impeller through a first set of discharge ports is directed to a second inlet for a second pass through the same impeller. The fluid then exits the impeller through a second set of discharge ports at an increased pressure. Finally, the fluid is directed to a pump outlet. Of course, additional passes through the same impeller are possible.

A primary advantage of the present invention is reduced overall efficiency losses due to mechanical drag from using the subject single-impeller, multi-stage pump of the present invention.

A further advantage is realized by the multi-pass single impeller obtaining high discharge pressures without requiring a large impeller diameter.

Another advantage of the present invention over the prior art is that the overall pump weight is reduced.

Still another advantage is that the overall size of the pump is reduced.

Still other features and benefits of the invention will be apparent to those skilled in the art upon reading and understanding the following detailed description.

BRIEF DESCRIPTION OF THE DRAWINGS

The structure, operation and advantages of the presently preferred embodiment of this invention will become further apparent upon consideration of the following description, taken in conjunction with the accompanying drawings. Of course, the drawings are only for purposes of illustrating preferred embodiments and are not to be construed as limiting the invention.

DETAILED DESCRIPTION OF THE INVENTION

Figure 1:
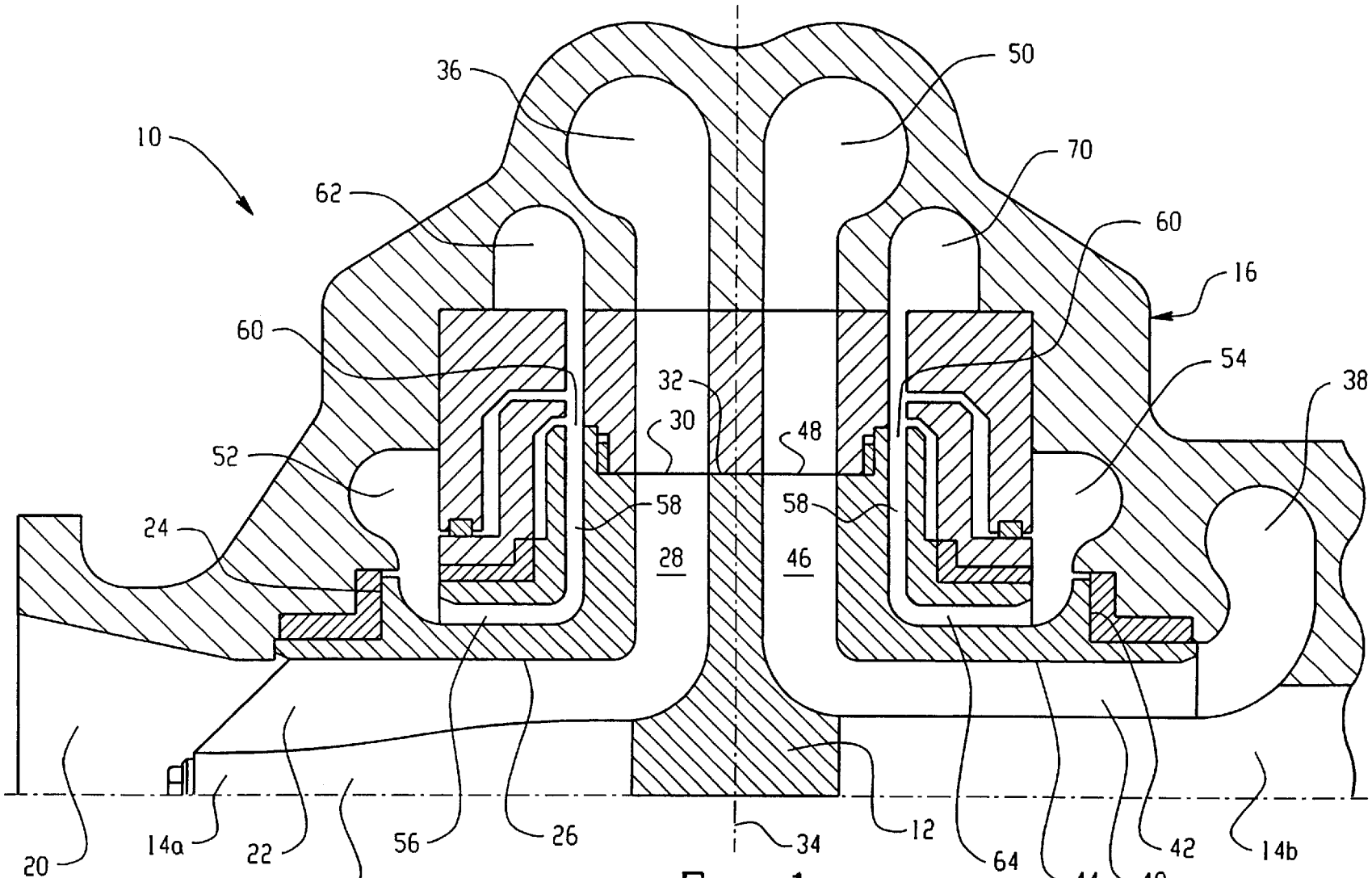
FIG. 1 illustrates a partial cross-sectional view of the impeller in one embodiment of the present invention.

Referring now to the drawings wherein like reference characters represent like elements. The impeller of the present invention may have any number of inlets on one or both of its faces. Each inlet represents the beginning of a separate pump stage. Thus, in a first pump stage the fluid enters a specific or first impeller inlet and is discharged from a first set of discharge ports in operative communication with the first inlet. The fluid is then routed to a second or successive impeller inlet to begin the second pump stage. Each stage, or pass through the impeller, incrementally increases the pressure of the fluid. The number of stages or passes that may be accomplished through a single impeller is theoretically unlimited, but in accordance with the present invention two or three passes are preferred.

Multiple passes through the improved single impeller of this invention provide high discharge pressures to be attained without many of the disadvantages of the prior art. As will be evident to those skilled in the art, a single impeller capable of multiple passes can be accomplished in a variety of manners.

With reference to FIG. 1, a centrifugal pump indicated generally by reference numeral 10 illustrates one embodiment of the present invention. The rotational components of the pump 10 includes an impeller 12 and a shaft 14. The impeller 10 is connected to the shaft 14 by any known means. The shaft interconnects a drive output from a motor (not shown) to rotatably drive the impeller 12. A housing or casing 16 includes an internal chamber 18 for operatively receiving the impeller 12 and the shaft 14. The housing 16 also includes a pump inlet 20 and a pump outlet (not shown).

The pump inlet 20 is an axial inlet disposed adjacent a rotational axis of the impeller. The inlet 20 is in fluid communication with a first impeller inlet 22 located on a first face 24 of the impeller 12. The first impeller inlet 22 is annularly disposed between a distal end 14a of the shaft 14 and an interior wall 26 of the impeller 12. The first impeller inlet leads to a first set of fluid channels 28 that extend through the impeller and connect the first impeller inlet to a first set of discharge ports 30. The fluid channels may be of any variety as is well known in the art.

The first set of discharge ports 30 are located on a peripheral edge 32 of the impeller. Specifically, the first set of discharge ports 30 are axially spaced from a central axis 34 that extends perpendicular to the rotational axis of the impeller and generally parallel to the first face 24 of the impeller 12. A first discharge chamber 36 is provided in the housing 16. The first discharge chamber 36 receives the fluid from the first set of discharge ports 30 as it exits from the impeller.

The first discharge chamber 36 is connected to a second inlet chamber 38 by any known fluid communication means (not shown). For example, passages in the housing direct the fluid from the first discharge chamber to the second inlet chamber (shown in FIG. 1 as being located on an axially opposite end of the impeller from the first inlet chamber). The second inlet chamber 38 redirects fluid to a second impeller inlet 40 such that the fluid may enter the impeller 12 in a generally axial direction. The second impeller inlet 40, located on a second face 42 of the impeller 12, is annularly disposed between the shaft and the interior wall 44 of the impeller. The second impeller inlet 40 leads to a second set of fluid channels 46. The fluid channels 46 proceed through the impeller and connect the second impeller inlet 40 to a second set of discharge ports 48. Again, the fluid channels may be of any variety as is well known(i.e., radial, axial, circumferential, or a combination of these).

The second set of discharge ports 48 are located on the peripheral edge 32 of the impeller. Specifically, the second set of discharge ports 48 are axially offset from the central axis 34 in the direction of the second face 42 of the impeller. A second discharge chamber 50 is provided in the housing and is in fluid communication with the second set of discharge ports 48 to receive fluid as it exits the impeller from the second set of channels 46.

Third and fourth inlet chambers 52, 54 are provided in the impeller to provide an actuator stage. The inlets are disposed on opposite ends or faces of the impeller and communicate with axially extending impeller inlets 56, 64, respectively. The impeller inlets 56, 64 are located radially outward relative to the first impeller inlet 22 and communicate with a third set of fluid channels 58. The fluid channels 58 extend radially through the impeller connecting the third impeller inlet to a third set of discharge ports 60. As with the first and second set of discharge ports, the third set of discharge ports 60 are located on the peripheral edge 32 of the impeller and are axially offset on opposite sides of the central axis 34 in the direction of the first face and second faces of the impeller. Third discharge chambers 62, 70 are provided in the housing 16 and fluidly connect to the third set of discharge ports for receiving fluid as it exits the impeller from the third set of channels 58.

The third and fourth discharge chambers 62 and 70 are connected to an actuator outlet (not shown). At a point before the actuator outlet, the fluid from the third and fourth discharge chambers 62 and 70 reconvenes and exits the pump 10 as a single fluid stream.

In operation, fluid enters the pump 10 through the pump inlet 20 and is axially directed into the first impeller inlet 22. The motor (not shown) rotates the impeller 12 via the shaft 14. The rotation of the impeller causes the fluid entering the first impeller inlet 22 to be centrifugally forced radially outwardly through the first set of fluid channels 28. The fluid then exits the impeller 12 through the first set of discharge ports 30 and is received in the first discharge chamber 36. As a result of the centrifugal forces, the fluid received in the first discharge chamber 36 is at a higher pressure than when the fluid first entered the impeller.

The fluid is then directed to the second inlet chamber 38 where the fluid is axially directed for reentry into the impeller. Fluid enters the second impeller inlet 40 and is again forced radially outwardly through a second set of fluid channels 46 due to the rotation of the impeller 12. The fluid exits the impeller 12 through the second set of discharge ports 68 and is received in a second discharge chamber 50. The fluid received in the second discharge chamber 50 is at an even higher pressure than when the fluid entered the impeller for the second time.

Although the third and fourth inlets, fluid channels, and discharge ports are intended for use as an actuator in FIG. 1, this embodiment illustrates how additional passages can be formed in the impeller without adversely affecting the function of the impeller. It will be understood by one skilled in the art that these additional passages could also be converted to third and fourth stages if appropriate.

Figure 2:
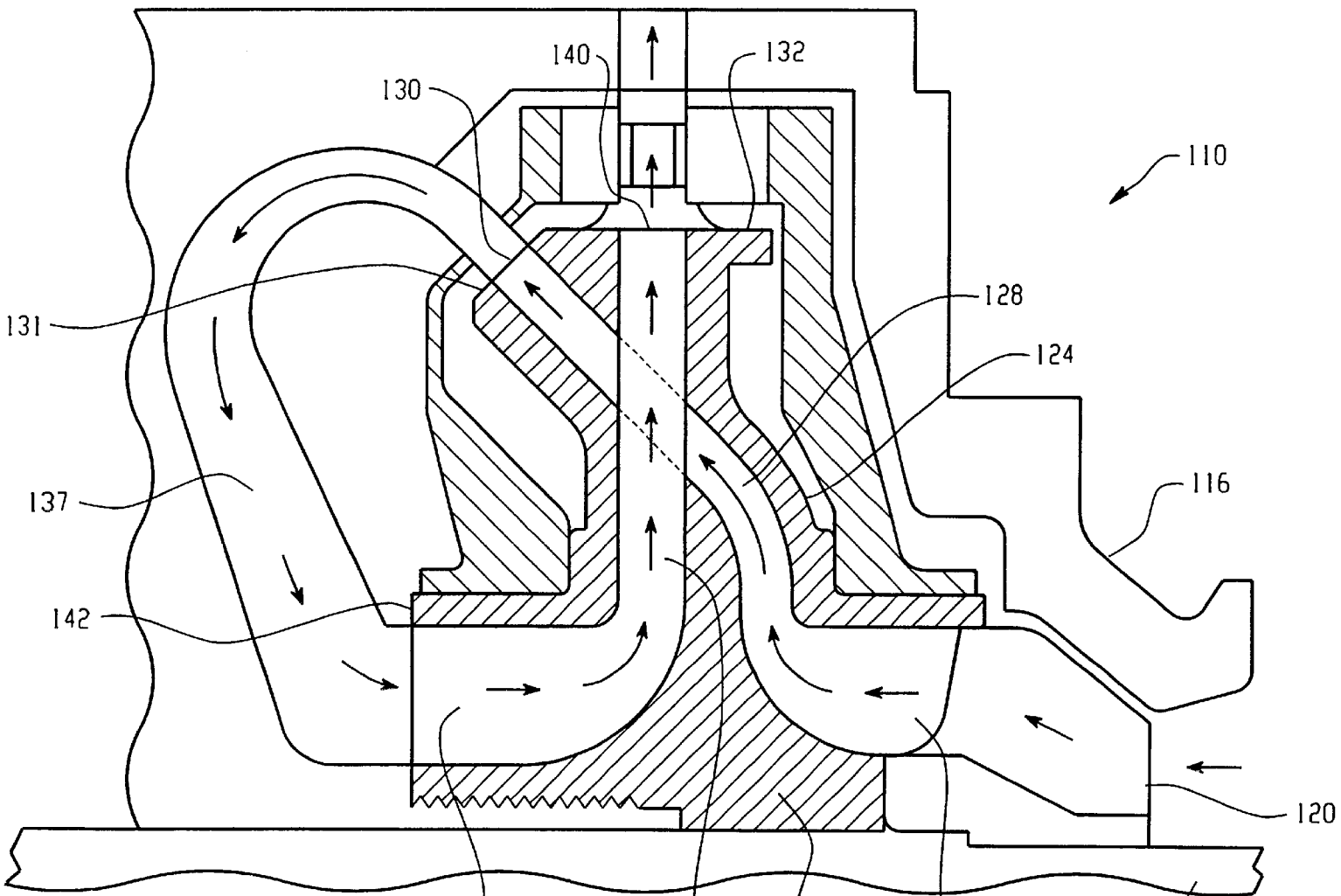
FIG. 2 illustrates a partial cross-sectional view of the impeller in a second embodiment of the present invention.

With reference to FIG. 2, a second embodiment of the present invention is shown. Where possible, components in the FIG. 2 embodiments are identified by a "100" series to correspond with like components having the same last two digits in the embodiment of FIG. 1 (e.g., impeller 12 from FIG. 1 generally corresponds to impeller 112 in FIG. 2). A centrifugal pump 110 has an impeller 112 and a shaft 114. The pump 110 includes a housing or casing 116 which includes an internal chamber 118 for operatively receiving the impeller 112 and the shaft 114. Additionally, the casing 116 includes a pump inlet 120 and a pump outlet (not shown).

The pump inlet 120 is in fluid communication with a first impeller inlet 122 located on a first face 124 of the impeller 112. The first impeller inlet 122 is annularly disposed on the first face 124. The first impeller inlet 122 is in fluid communication with a first set of channels 128 that axially and radially extend and thereby connect the first impeller inlet to a first set of discharge ports 130. The first set of discharge ports 130 are preferably located on a chamfered peripheral edge 131 which is located between an outer diameter 132 of the impeller and a second face 142 of the impeller.

A fluid communication means or passage 137 receives fluid from the first set of discharge ports 130 and redirects the fluid into a second impeller inlet 140. The second impeller inlet 140 is annularly disposed on the second face 142 of the impeller and is in fluid communication with a second set of channels 146. The fluid channels run through the impeller connecting the second impeller inlet 140 to a second set of discharge ports 140. The first and second set of fluid channels 128 and 146 cross-over one another but are not in fluid communication with one another. In this manner, each pass through the impeller increases the pressure and a multi-stage pump is achieved with a single impeller. The second set of discharge ports 140 are located on the radial peripheral edge 132 and in fluid communication with the pump outlet such that fluid may be discharged from the pump upon completion of two passes through the impeller.

In operation, fluid enters the pump 110 through the pump inlet 120 and is axially directed into the first impeller inlet 122. The impeller 112 rotates via the shaft 114 causing the fluid entering the first impeller inlet to be centrifugally forced radially outwardly through the first set of fluid channels 128 and exit the impeller 112 through the first set of discharge ports 130. The exiting fluid is at a higher pressure than the fluid first entering the impeller.

The fluid is then directed through the fluid passage 137 to the second impeller inlet 140 where the fluid again enters the impeller. The rotation of the impeller imparts further energy to the fluid and forces the fluid radially outwardly. The fluid flows through the second set of fluid channels 146 and exits the impeller through the second set of discharge ports 168. The fluid exiting the impeller for a second time is at an even higher pressure than the fluid exiting the impeller after the first pass. The fluid is then directed to the pump outlet after two passes through the impeller in which each pass incrementally increases the pressure of the fluid.

Figure 3:
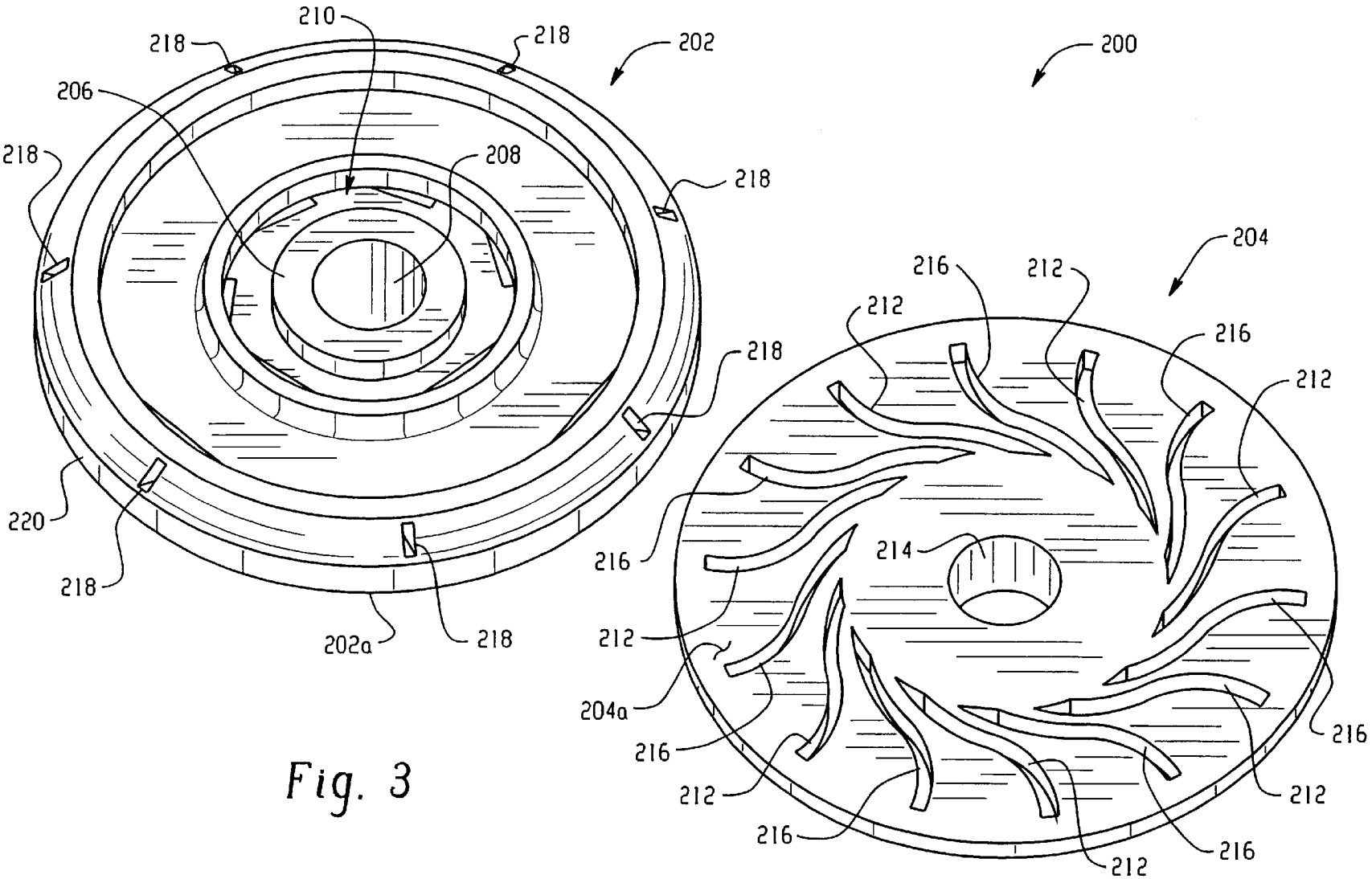
FIG. 3 illustrates an exploded perspective view of the impeller in a third embodiment of the present invention.

A third embodiment of the present invention is shown in FIG. 3. An impeller 200 of the centrifugal pump is shown in a disassembled state and includes a first and second member 202 and 204. Each member 202 and 204 includes a substantially planar face 202*a* and 204*a* disposed in facing relation and that allow members 202 and 204 to be abutted together.

The first member includes a hub 206 having a circular opening 208 that receives a drive shaft for rotational engagement. A first impeller inlet 210 is annularly disposed around the hub and is in fluid communication with a first set of flow channels 212. The second member 204 defines the remainder of the first set of flow channels 212. The first set of flow channels 212 connects the first impeller inlet 210 to a first set of discharge ports located on the first chamfered edge of the second member 204. The second member 204 is substantially a mirror image of the first member. That is, a second impeller inlet (not shown) is annularly disposed around a second hub portion (not shown) in the same manner as the hub portion 206 of the first member 202. A second set of flow channels 216 is partially defined by the second member 204. The first member 202 defines the remainder of the second set of flow channels 216. The second set of flow channels 216 connects the second impeller inlet to a second set of discharge ports 218 located on the second chamfered edge.

The first and second members 202 and 204 are joined together in any conventional manner. For example, the members 202 and 204 are brazed together once the fluid flow channels 212 and 216 are aligned. The respective sets of channels 212 and 216 cross over one another but are not in fluid communication with one another for reasons described above. The resultant impeller 200 has the capability of a two-stage pump achieved with only a single impeller.

What is claimed is:

1. A method of increasing the pressure of a fluid in a centrifugal pump by forcing the fluid to make multiple passes through one impeller of the centrifugal pump, the method comprising the steps:

providing fluid to a first inlet of a centrifugal pump impeller;

rotating the impeller to increase the pressure of the fluid and cause the fluid to exit from the impeller;

directing exiting fluid to a second inlet of the same impeller to make a second pass through the impeller and further increase the fluid pressure and cause the fluid to again exit from the impeller, wherein the first and second inlets are generally parallel to the axis of rotation of the impeller and radially aligned with one another.

2. The method according to claim 1 further comprising the step of:

directing fluid to a third inlet of the same impeller.

3. The method according to claim 2 wherein the step of directing fluid to the third inlet includes directing the fluid again exiting the impeller after the second pass therethrough to the third inlet of the impeller.

4. The method according to claim 3, further comprising the step of:

directing fluid to a fourth inlet of the same impeller.

5. The method according to claim 1 wherein the step of rotating the impeller to increase the pressure of the fluid from the first inlet includes the sub-step of:

directing the fluid from the first inlet located on a first face of the impeller to a first set of outlet ports located on a second face of the impeller axially spaced relative to the first face of the impeller.

6. The method according to claim 1 wherein the step of directing exiting fluid to a second inlet of the same impeller to make a second pass through the impeller includes the sub-step of:

directing the fluid making the second pass through the impeller to cross over the fluid making the first pass through the impeller.

7. A centrifugal pump comprising:

a housing having an internal chamber, a pump inlet, and a pump outlet;

an impeller operatively received in the internal chamber having first and second impeller faces, the impeller includes a first impeller inlet located on the first impeller face, a first set of impeller outlet ports located on the second impeller face, and a first set of channels for fluid communication between the first impeller inlet on the first impeller face and the first set of impeller outlet ports disposed in the impeller on the second impeller face.

8. The centrifugal pump of claim 7 wherein the impeller includes a second impeller inlet located on one of the first and second impeller faces, a second set of impeller outlet ports, and a second set of channels for fluid communication between the second impeller inlet and the second set of impeller outlet ports.

9. The centrifugal pump of claim 8 wherein the first set of impeller outlet ports is in fluid communication with the second impeller inlet.

10. The centrifugal pump of claim 8 where in the second impeller inlet is located on the second impeller face and the second set of impeller outlet ports is located on the first impeller face.

11. The centrifugal pump of claim 8 wherein one of the first and second sets of channels axially crosses over the other of the first and second sets of channels.

12. The centrifugal pump of claim 8 wherein the second impeller face is axially spaced in relation to the first impeller face.

13. The centrifugal pump of claim 7 wherein the second impeller face includes a chamfered peripheral edge located at an angle between a general axial plane of the second impeller face and a general radial plane of an outer diameter of the impeller.

14. The centrifugal pump of claim 13 wherein the impeller includes a second impeller inlet located on the second impeller face in fluid communication with the first set of discharge ports.

15. A centrifugal pump comprising:

a housing having an internal chamber, a pump inlet, and a pump outlet;

an impeller operatively received in the internal chamber having first and second impeller faces, the impeller includes a first impeller inlet located on one of the first and second impeller faces, a second impeller inlet located on one of the first and second impeller faces, a first set of impeller outlet ports located on the impeller, a second set of impeller outlet ports located on the impeller, a first set of channels for fluid communication between the first impeller inlet and the first set of impeller outlet ports, and a second set of channels for fluid communication between the second impeller inlet and the second set of impeller outlet ports;

wherein the first set of impeller outlet ports is in fluid communication with the second impeller inlet;

wherein the impeller includes a third impeller inlet located on one face of the impeller in fluid communication with the second set of outlet ports, a third set of outlet ports located on the impeller, and a third set of fluid channels fluidly connecting the third impeller inlet with the third set of fluid outlet ports; and wherein the impeller includes a fourth impeller inlet located on one face of the impeller, a fourth set of outlet ports located on the impeller, and a fourth set of fluid channels fluidly connecting the fourth impeller inlet with the fourth set of fluid outlet ports.

16. The centrifugal pump of claim 15 wherein the fourth impeller inlet is in fluid communication with the second set of discharge ports allowing the fluid to divide between the third and fourth impeller inlets.

17. An impeller for use in a centrifugal pump of an aircraft fuel system, comprising:

a first impeller half member having a first half first face that defines a first face portion of a central shaft opening, a first half inlet annularly disposed around and adjacent to the first face portion, and a plurality of first half discharge ports annularly disposed around the first half inlet near a peripheral radial edge of the first half member;

a second impeller half member having a second half first face that defines a second face portion of the central shaft opening, a second half inlet annularly disposed around and adjacent to the second face portion, and a plurality of second half discharge ports annularly disposed around the second half inlet near a peripheral radial edge of the second half member; and first and second sets of fluid passages together defined by the first and second impeller half members, the first set of fluid passages fluidly connecting the first inlet of the first half member and the plurality of second half discharge ports of the second half member and the second set of fluid passages fluidly connecting the second inlet of the second half member and the plurality of first half discharge ports of the first half member.

18. The impeller according to claim 17 wherein:

the first set of fluid passages a redefined by a first set of channels defined within a second face of the first half member connecting the first inlet to the second face of the first half member and a second set of channels defined within a second face of the second half member connecting the second half discharge ports to the second face of the second half member; and the second set of fluid passages are defined by a third set of channels defined within the second face of the second half member connecting the second inlet to the second face of the second half member and a fourth set of channels defined within the second face of the first half member connecting the first half discharge ports to the first face of the first half member.

19. The impeller according to claim 17 wherein the first and second impeller half member s are brazed together.

20. The impeller according to claim 17 wherein the first set of fluid passages axially crosses over the second set of fluid passages without fluidly communicating directly with one another.

* * * * *